US010923794B2

(12) United States Patent
Jang et al.

(10) Patent No.: US 10,923,794 B2
(45) Date of Patent: Feb. 16, 2021

(54) BASE STATION INCLUDING ANTENNA HAVING TWO-WAY TILTING STRUCTURE

(71) Applicant: Samsung Electronics Co., Ltd., Suwon-si (KR)

(72) Inventors: Minsoo Jang, Seongnam-si (KR); Youngjin Kim, Yongin-si (KR); Byungtae Yoon, Suwon-si (KR); Daeeop Lee, Suwon-si (KR); Jongwook Zeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/008,477

(22) Filed: Jun. 14, 2018

(65) Prior Publication Data

US 2018/0366809 A1 Dec. 20, 2018

(30) Foreign Application Priority Data

Jun. 16, 2017 (KR) ..... 10-2017-0076917

(51) Int. Cl.
*H01Q 1/12* (2006.01)
*H01Q 3/06* (2006.01)

(52) U.S. Cl.
CPC ..... *H01Q 1/1228* (2013.01); *H01Q 1/125* (2013.01); *H01Q 1/1242* (2013.01); *H01Q 3/06* (2013.01)

(58) Field of Classification Search
CPC ..... H01Q 1/12; H01Q 3/00–3/08; H01Q 1/22
USPC ..... 343/878–882, 890–892
See application file for complete search history.

(56) References Cited

U.S. PATENT DOCUMENTS 6,244,553 B1 * 6/2001 Wang ..... B60R 11/02 248/278.1
10,122,083 B2 * 11/2018 Kim ..... H01Q 3/06
2003/0223188 A1 12/2003 Ha et al.
2006/0023411 A1 * 2/2006 Ryu ..... G06F 1/1622 361/679.09
2011/0168855 A1 7/2011 Bonczyk et al.
2016/0211576 A1 * 7/2016 Vassilakis ..... H01Q 1/125
(Continued)

FOREIGN PATENT DOCUMENTS

EP 2 256 857 A1 12/2010
JP 60-105302 A 6/1985
(Continued)

OTHER PUBLICATIONS

European Search Report dated Oct. 22, 2018; Reference #: P19751EP; App #: 18177959.6-1220.
(Continued)

*Primary Examiner* — Hasan Z Islam
(74) *Attorney, Agent, or Firm* — Jefferson IP Law, LLP

(57) ABSTRACT

The disclosure provides a base station. The base station includes an enclosure including at least one pole connectable part to be connected to a communication pole, and an antenna assembly including an antenna for communication and combined with the enclosure. The enclosure further includes at least one antenna assembly combinable member to be combined with the antenna assembly. The antenna assembly is rotated at a predetermined angle on the at least one antenna assembly combinable member which operates as a pivot.

5 Claims, 14 Drawing Sheets

(56) References Cited

U.S. PATENT DOCUMENTS

| | | | | |
|---|---|---|---|---|
| 2017/0039405 | A1* | 2/2017 | Twogood ..... | G06K 7/10356 |
| 2018/0351248 | A1 | 12/2018 | Kim et al. | |

FOREIGN PATENT DOCUMENTS

| | | | |
|---|---|---|---|
| KR | 10-2009-0078608 | A | 7/2009 |
| WO | 2017/126898 | A1 | 7/2017 |

OTHER PUBLICATIONS

European Office Action dated Feb. 25, 2020, issued in European Application No. 18177959.6.

* cited by examiner

BASE STATION INCLUDING ANTENNA HAVING TWO-WAY TILTING STRUCTURE

CROSS-REFERENCE TO RELATED APPLICATION(S)

This application is based on and claims priority under 35 U.S.C. § 119(a) of a Korean patent application number 10-2017-0076917, filed on Jun. 16, 2017, in the Korean Intellectual Property Office, the disclosure of which is incorporated by reference herein in its entirety.

BACKGROUND

1. Field

The disclosure relates to a base station including an integrated type antenna assembly. More particularly, the disclosure relates to a base station capable of extending coverage through two-way tilting of an antenna.

2. Description of the Related Art

To meet the demand for wireless data traffic having increased since deployment of 4th generation (4G) communication systems, efforts have been made to develop an improved 5th generation (5G) or pre-5G communication system. Therefore, the 5G or pre-5G communication system is also called a 'beyond 4G network' or a 'post long term evolution (LTE) system'. The 5G communication system is considered to be implemented in higher frequency (mm Wave) bands, e.g., 60 GHz bands, so as to accomplish higher data rates. To decrease propagation loss of the radio waves and increase the transmission distance, the beamforming, massive multiple-input multiple-output (MIMO), full dimensional MIMO (FD-MIMO), array antenna, an analog beam forming, large scale antenna techniques are discussed in 5G communication systems. In addition, in 5G communication systems, development for system network improvement is under way based on advanced small cells, cloud radio access networks (RANs), ultra-dense networks, device-to-device (D2D) communication, wireless backhaul, moving network, cooperative communication, coordinated multi-points (CoMP), reception-end interference cancellation and the like. In the 5G system, Hybrid frequency-shift keying (FSK) and quadrature amplitude modulation (QAM) (FQAM) and sliding window superposition coding (SWSC) as an advanced coding modulation (ACM), and filter bank multi carrier (FBMC), non-orthogonal multiple access (NOMA), and sparse code multiple access (SCMA) as an advanced access technology have been developed.

The Internet, which is a human centered connectivity network where humans generate and consume information, is now evolving to the internet of things (IoT) where distributed entities, such as things, exchange and process information without human intervention. The internet of everything (IoE), which is a combination of the IoT technology and the Big Data processing technology through connection with a cloud server, has emerged. As technology elements, such as "sensing technology", "wired/wireless communication and network infrastructure", "service interface technology", and "Security technology" have been demanded for IoT implementation, a sensor network, a machine-to-machine (M2M) communication, machine type communication (MTC), and so forth have been recently researched. Such an IoT environment may provide intelligent Internet technology services that create a new value to human life by collecting and analyzing data generated among connected things. IoT may be applied to a variety of fields including smart home, smart building, smart city, smart car or connected cars, smart grid, health care, smart appliances and advanced medical services through convergence and combination between existing information technology (IT) and various industrial applications.

In line with this, various attempts have been made to apply 5G communication systems to IoT networks. For example, technologies such as a sensor network, MTC, and M2M communication may be implemented by beamforming, MIMO, and array antennas. Application of a cloud radio access network (RAN) as the above-described Big Data processing technology may also be considered to be as an example of convergence between the 5G technology and the IoT technology.

A base station antenna used in the 5G or conventional LTE communication is integrated into or separately installed near a base station. The base station antenna needs to control the directionality thereof in order to reduce the loss of radio waves radiated therefrom and accurately transmit signals.

That is, the base station antenna should be able to adjust the antenna direction vertically or horizontally. Typically used to adjust the antenna direction is a bracket assembled with the antenna for the base station or with the antenna-integrated base station.

Unfortunately, the use of an antenna-adjustable bracket has some drawbacks. Specifically, the bracket for adjusting the antenna requires a large number of parts and has a complicated assembly structure. Therefore, it is not only difficult to install the bracket, but also it takes a long time to install the bracket.

In addition, the bracket assembled with the base station causes an increase in weight of base station equipment. This makes it difficult for a worker to install the base station safely. Further, there is a high risk that a worker installing the base station may be injured during work, and the base station may be damaged by falling.

Also, the base station installed with a separate bracket on a communication pole or a wall surface protrudes outwardly, thus deteriorating the appearance.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a base station capable of extending coverage through two-way tilting of an antenna.

Additional aspects will be set forth in part in the description which follows and, in part, will be apparent from the description, or may be learned by practice of the presented embodiments.

In accordance with an aspect of the disclosure, a base station is provided. The base station includes an enclosure including at least one pole connectable part to be connected to a communication pole, and an antenna assembly including an antenna for communication and combined with the enclosure. The enclosure further includes at least one antenna assembly combinable member to be combined with the antenna assembly. The antenna assembly is rotated at a predetermined angle on the at least one antenna assembly combinable member which operates as a pivot.

In the base station, the at least one antenna assembly combinable member may include at least one upper antenna assembly combinable member disposed on at least one upper lateral side of the enclosure, and at least one lower antenna assembly combinable member disposed on at least one lower lateral side of the enclosure.

The base station may further include at least one supporting member disposed between the at least one upper antenna assembly combinable member and the at least one lower antenna assembly combinable member and performing a function of maintaining a tilting angle of the antenna assembly from the enclosure.

In the base station, the at least one supporting member may include a fastening protrusion joined to the enclosure and protruding toward the antenna assembly, and the antenna assembly may further include an elongated hole formed at a position corresponding to a position of the fastening protrusion.

In the base station, the at least one supporting member may further include a washer engaged with the fastening protrusion, and a cover covering the fastening protrusion.

In the base station, the elongated hole may include at least one stopper formed as an inwardly curved part.

In the base station, the supporting member may further include an elastic part formed to elastically join the enclosure and the fastening protrusion.

In the base station, a width of the elongated hole may be widened gradually toward the communication pole to be connected to the enclosure.

In the base station, the at least one antenna assembly combinable member may include first and second upper antenna assembly combinable members disposed on upper lateral sides of the enclosure, and third and fourth lower antenna assembly combinable members disposed on lower lateral sides of the enclosure.

In the base station, the first and second antenna assembly combinable members may be disposed respectively on both upper lateral sides of the enclosure, and the third and fourth antenna assembly combinable members may be disposed respectively on both lower lateral sides of the enclosure.

The base station may further include a first supporting member disposed between the first and third antenna assembly combinable members and performing a function of maintaining a tilting angle of the antenna assembly from the enclosure; and a second supporting member disposed between the second and fourth antenna assembly combinable members and performing the function of maintaining the tilting angle.

In the base station, the first and second supporting members may include first and second fastening protrusions, respectively, each joined to the enclosure and protruding toward the antenna assembly, and the antenna assembly may further include first and second elongated holes formed respectively at positions corresponding to positions of the first and second fastening protrusions.

In the base station, the first supporting member may further include a first washer engaged with the first fastening protrusion, and a first cover covering the first fastening protrusion. Also, the second supporting member may further include a second washer engaged with the second fastening protrusion, and a second cover covering the second fastening protrusion.

In the base station, each of the first and second elongated holes may include at least one stopper formed as an inwardly curved part.

In the base station, the first supporting member may further include a first elastic part formed to elastically join the enclosure and the first fastening protrusion, and the second supporting member may further include a second elastic part formed to elastically join the enclosure and the second fastening protrusion.

In the base station, a width of each of the first and second elongated holes may be widened gradually toward the communication pole to be connected to the enclosure.

According to various embodiments of the disclosure, it is possible to adjust the direction of the antenna by rotating only the antenna assembly without using a separate bracket. Therefore, the number of parts used for manufacturing the base station can be reduced with a reduced installation time of the base station and reduced material cost.

In addition, the antenna assembly can be easily assembled, and the antenna direction can be simply adjusted. Therefore, the base station can be installed with only one worker, and the stability and efficiency of a work for installing the base station can be improved.

Also, the base station makes it possible to radiate radio waves upwardly as well as downwardly through two-way antenna tilting. This can improve the coverage of the base station.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which.

Throughout the drawings, like reference numerals will be understood to refer to like parts, components, and structures.

DETAILED DESCRIPTION

Figure 1A:
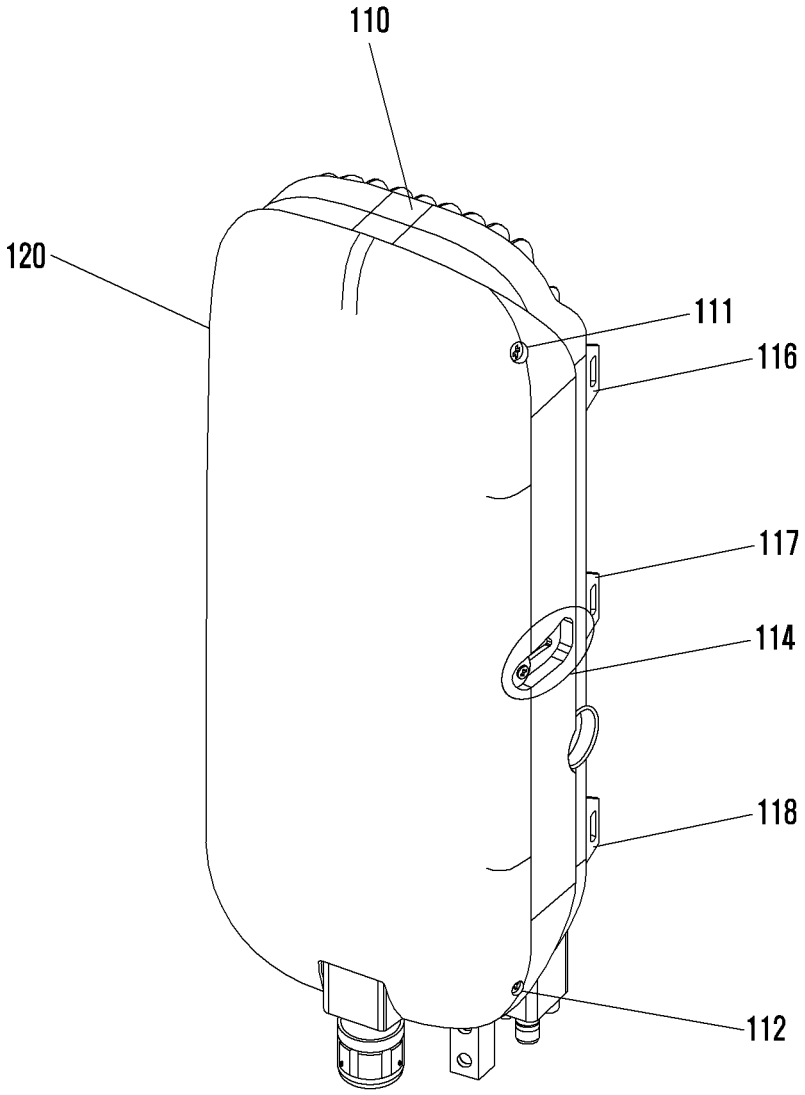
FIGS. 1A, 1B, and 1C are views illustrating a base station according to various embodiments of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

For the same reason, some elements in the drawings are exaggerated, omitted, or schematically illustrated. Also, the size of each element does not entirely reflect the actual size. In the drawings, the same or corresponding elements are denoted by the same reference numerals.

The advantages and features of the disclosure and the manner of achieving them will become apparent with reference to embodiments described in detail below with reference to the accompanying drawings. The disclosure may, however, be embodied in many different forms and should not be construed as limited to embodiments set forth herein. Rather, these embodiments are provided so that this disclosure will be thorough and complete, and will fully convey the scope of the disclosure to those skilled in the art. To fully disclose the scope of the disclosure to those skilled in the art, and the disclosure is only defined by the scope of claims.

It will be understood that each block of the flowchart illustrations, and combinations of blocks in the flowchart illustrations, may be implemented by computer program instructions. These computer program instructions may be provided to a processor of a general purpose computer, special purpose computer, or other programmable data processing apparatus to produce a machine, such that the instructions, which are executed via the processor of the computer or other programmable data processing apparatus, generate means for implementing the functions specified in the flowchart block or blocks. These computer program instructions may also be stored in a computer usable or computer-readable memory that may direct a computer or other programmable data processing apparatus to function in a particular manner, such that the instructions stored in the computer usable or computer-readable memory produce an article of manufacture including instruction means that implement the function specified in the flowchart block or blocks. The computer program instructions may also be loaded onto a computer or other programmable data processing apparatus to cause a series of operations to be performed on the computer or other programmable apparatus to produce a computer implemented process such that the instructions that are executed on the computer or other programmable apparatus provide operations for implementing the functions specified in the flowchart block or blocks.

In addition, each block of the flowchart illustrations may represent a module, segment, or portion of code, which comprises one or more executable instructions for implementing the specified logical function(s). It should also be noted that in some alternative implementations, the functions noted in the blocks may occur out of the order. For example, two blocks shown in succession may in fact be executed substantially concurrently or the blocks may sometimes be executed in the reverse order, depending upon the functionality involved.

The term "unit", as used herein, may refer to a software or hardware component or device, such as a field programmable gate array (FPGA) or application specific integrated circuit (ASIC), which performs certain tasks. A unit may be configured to reside on an addressable storage medium and configured to execute on one or more processors. Thus, a module or unit may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and units may be combined into fewer components and units or further separated into additional components and modules. In addition, the components and units may be implemented to operate one or more central processing units (CPUs) in a device or a secure multimedia card.

Figure 1B:
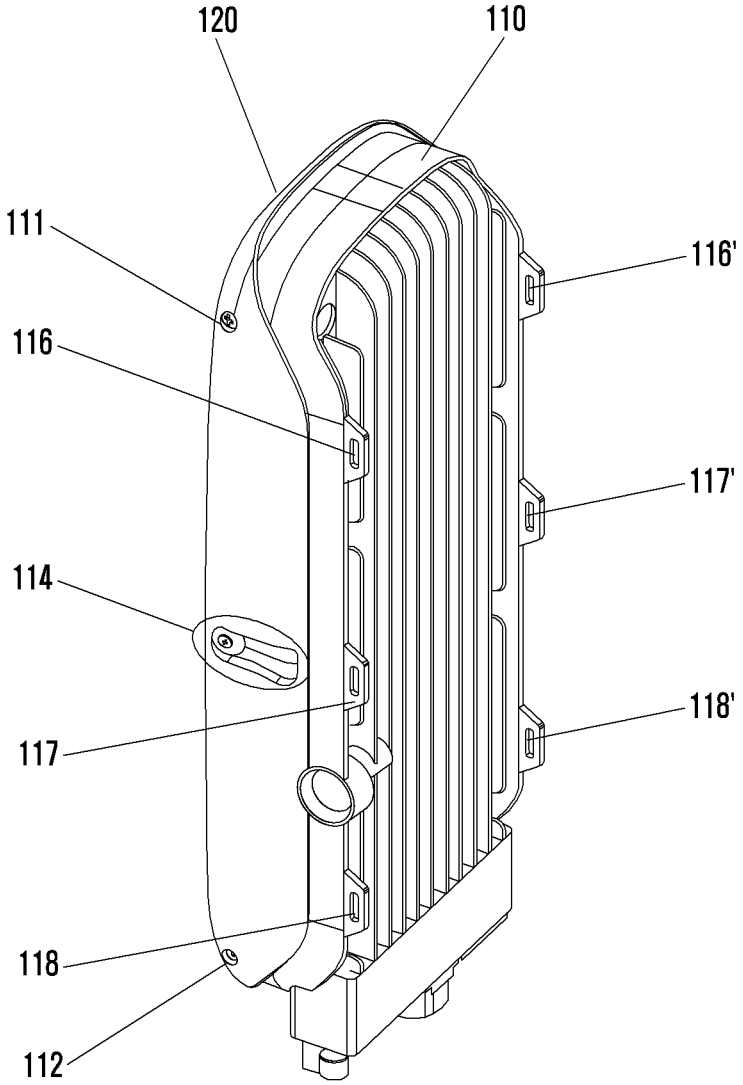
Figure 1C:
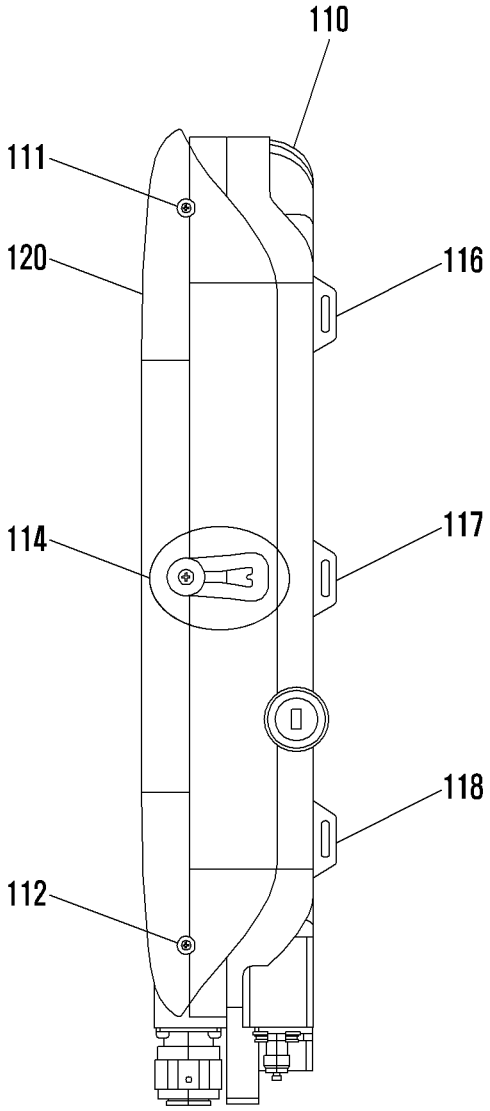

FIGS. 1A, 1B, and 1C are views illustrating a base station according to various embodiments of the disclosure.

Referring to FIGS. 1A, 1B, and 1C, the base station according to an embodiment may include an enclosure 110 and an antenna assembly 120. The enclosure 110 has a plurality of pole connectable parts 116, 117, 118, 116', 117', and 118' to be connected to a certain pole such as a communication pole. The antenna assembly 120 has an antenna (e.g., 125 in FIGS. 2A and 2B) for communication and is combined with the enclosure 110.

The enclosure 110 may include therein a controller (not shown) for processing a signal transmitted/received through the communication antenna. Although not shown, the enclosure 110 may further include therein various communication devices for the operation of the base station.

The enclosure 110 may be provided with at least one antenna assembly combinable member to be combined with the antenna assembly 120. Referring to FIG. 1A to 1C, four antenna assembly combinable members are shown as an example.

Specifically, a first antenna assembly combinable member 111 and a second antenna assembly combinable member (not shown), i.e., a pair of upper antenna assembly combinable members, are provided respectively on both upper lateral sides of the enclosure 110. That is, the first antenna assembly combinable member 111 is disposed on one upper lateral side of the enclosure, and the second antenna assembly combinable member (not shown) is disposed on the opposite upper lateral side. Similarly, a third antenna assembly combinable member 112 and a fourth antenna assembly combinable member (not shown), i.e., a pair of lower antenna assembly combinable members, are provided respectively on both lower lateral sides of the enclosure 110. That is, the third antenna assembly combinable member 112 is disposed on one lower lateral side of the enclosure, and the fourth antenna assembly combinable member (not shown) is disposed on the opposite lower lateral side.

The antenna assembly 120 may be rotated at a predetermined angle on a pair of the antenna assembly combinable members. That is, a pair of the first and second antenna assembly combinable members or a pair of the third and fourth antenna assembly combinable members can operate as a pivot on which the antenna assembly 120 is tilted at a predetermined angle from the enclosure 110. This will be described in detail with reference to FIGS. 3A to 3C and 4A to 4C.

Meanwhile, the antenna assembly 120 may operate as a cover of the enclosure 110 as shown in FIGS. 1A to 1C. That is, the antenna assembly 120 may act as a frame for supporting the antenna 125 joined thereto, and may also act as a cover for protecting the enclosure 110 from an external impact.

Each of the antenna assembly combinable members may be configured using a hinge screw. This is, however, not to be construed as a limitation of the disclosure. Any equivalent that allows the antenna assembly to be tilted may be used instead of the antenna assembly combinable members.

In addition, although it is shown in the drawings that four antenna assembly combinable members are used for the base station, this is not to be construed as a limitation of the disclosure. The number of the antenna assembly combinable members may be changed according to a design scheme of the base station.

Meanwhile, the base station according to the disclosure may include at least one supporting member as shown in FIGS. 1A to 1C. Specifically, in FIGS. 1A to 1C, a first supporting member 114 and a second supporting member (not shown) are disposed respectively on both middle lateral sides of the enclosure 110. That is, the first supporting member 114 is disposed on one middle lateral side of the enclosure, and the second supporting member (not shown) is disposed on the opposite middle lateral side.

The first supporting member 114 is disposed between the first antenna assembly combinable member 111 and the third antenna assembly combinable member 112 and performs a function of maintaining a tilting angle of the antenna assembly 120 from the enclosure 110. Similarly, the second supporting member is disposed between the second antenna assembly combinable member and the fourth antenna assembly combinable member and performs a function of maintaining a tilting angle of the antenna assembly 120 from the enclosure 110. A detailed description of the first and second supporting members will be given below with reference to FIGS. 3 to 5.

Although it is shown in the drawings that two supporting members are used for the base station, this is not to be construed as a limitation of the disclosure. The number of the supporting members may be changed according to a design scheme of the base station.

Figure 2A:
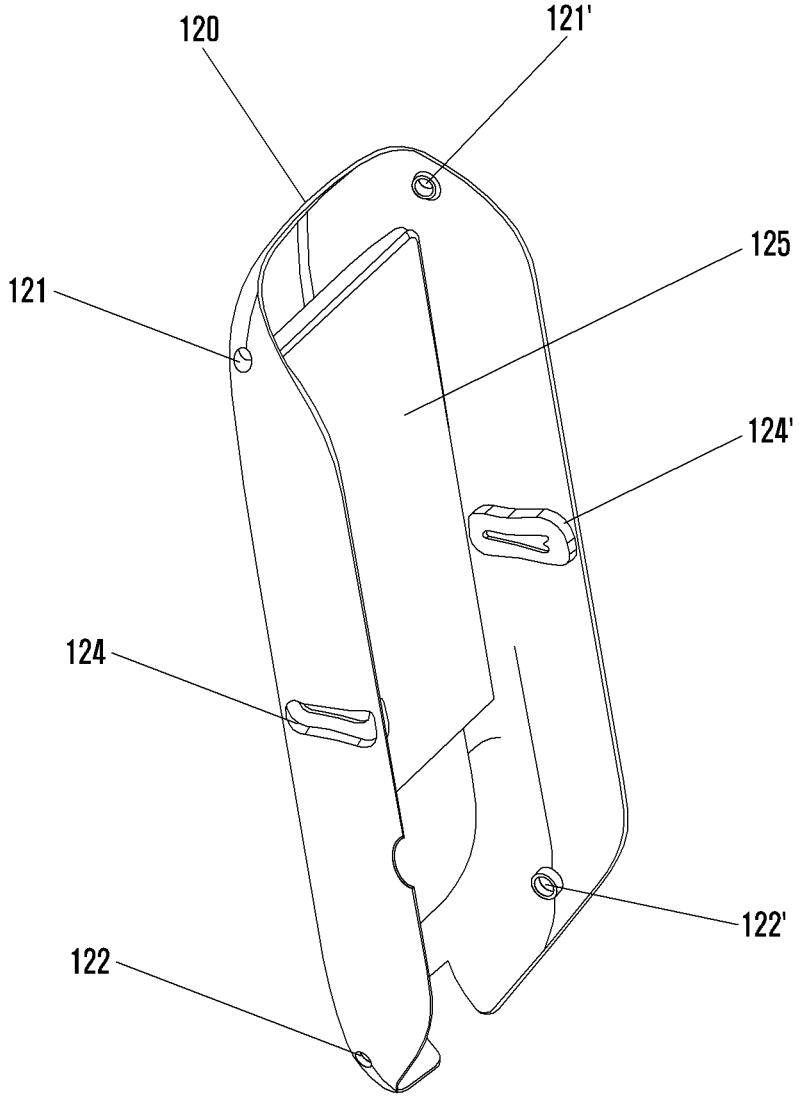
FIGS. 2A and 2B are views illustrating an antenna assembly according to various embodiments of the disclosure.
Figure 2B:
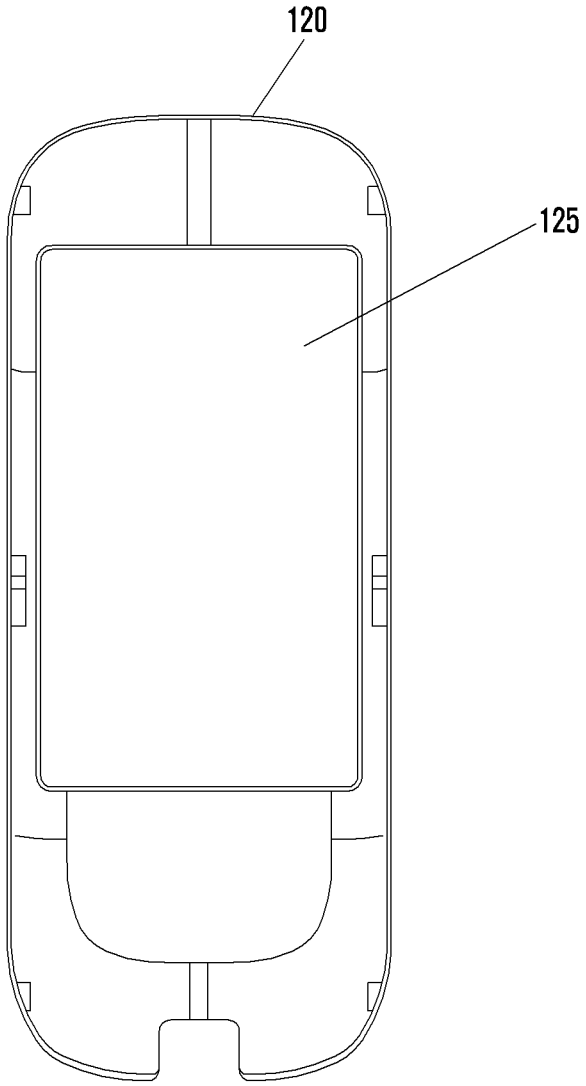

FIGS. 2A and 2B are views illustrating an antenna assembly according to various embodiments of the disclosure.

Referring to FIGS. 2A and 2B, as described above, the antenna assembly 120 has the antenna 125 for communication. For example, as shown, the antenna assembly 120 is configured to surround one side of the antenna 125. Therefore, the antenna 125 is not exposed to the outside through the antenna assembly 120, thus being protected from external impact.

The antenna assembly 120 may have an elongated hole for engaging with the above-described supporting member of the enclosure. For example, a first elongated hole 124 may be formed at a position corresponding to the position of the first supporting member (114 in FIGS. 1A to 1C), a second elongated hole 124' may be formed at a position corresponding to the position of the second supporting member (not shown).

Each of the first and second elongated holes 124 and 124' for engaging with the supporting members may have various shapes. This will be described in detail with reference to FIGS. 5A and 5B.

As shown in FIG. 2A, the antenna assembly 120 may also include a plurality of enclosure combinable holes, which respectively correspond to and are to be combined with the above-described antenna assembly combinable members of the enclosure.

Specifically, a first enclosure combinable hole 121 is formed at a position corresponding to the position of the first antenna assembly combinable member (111 in FIGS. 1A to 1C), and a second enclosure combinable hole 121' is formed at a position corresponding to the position of the second antenna assembly combinable member (not shown). Similarly, a third enclosure combinable hole 122 is formed at a position corresponding to the position of the third antenna assembly combinable member (112 in FIGS. 1A to 1C), and a fourth enclosure combinable hole 122' is formed at a position corresponding to the position of the fourth antenna assembly combinable member (not shown).

The enclosure 110 and the antenna assembly 120 may be combined with each other through the plurality of enclosure combinable holes and the plurality of antenna assembly combinable members. After combined, the antenna assembly 120 may be rotated (i.e., tilted) on a pair of the upper or lower antenna assembly combinable members. This will be described in detail below.

When each of the antenna assembly combinable members is configured using a hinge screw as mentioned above, each of the first enclosure combinable hole 121, the second enclosure combinable hole 121', the third enclosure combinable hole 122, and the fourth enclosure combinable hole 122' is formed in the antenna assembly 120 as shown in FIG. 2A to receive the corresponding hinge screw.

However, the structure, configuration, shape, etc. of the antenna assembly shown in the drawings are not to be construed as a limitation of the disclosure. As will be understood by a person skilled in the art, any other antenna assembly that operates on the principle similar to that of the disclosure is considered as being within the scope of the disclosure.

Meanwhile, the antenna 125 joined to the antenna assembly 120 as shown in FIGS. 2A and 2B may be configured to allow electrical tilting.

The electrical tilting refers to a technique of varying the radiation direction of radio waves radiated by the antenna 125. Normally, the electrical tilting may be realized by tilting the radio wave radiation direction of an antenna array constituting the antenna 125 or by connecting a driving mechanism such as a motor to the antenna 125.

In addition to the electrical tilting, mechanical tilting according to the disclosure (i.e., tilting of the antenna by the rotation of the antenna assembly as described above) may be further applied to the base station antenna. Therefore, in this case, a tilting range of the antenna may be increased in comparison with a case where only the electrical tilting is used.

Hereinafter, the mechanical tilting of the base station antenna caused by the rotation of the antenna assembly will be described in detail. According to the base station structure disclosed herein, the base station allows two-way mechanical tilting, as follows.

Figure 3A:
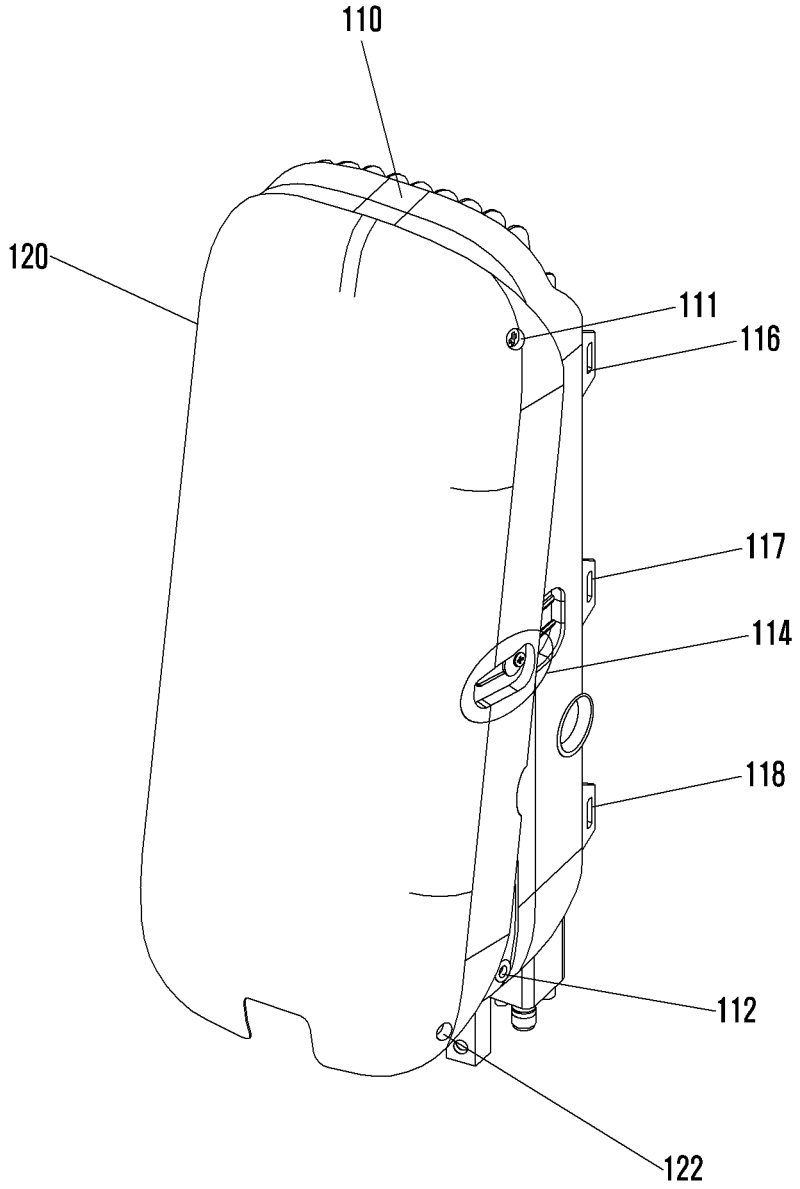
FIGS. 3A, 3B, and 3C are views illustrating an antenna assembly tilted from the bottom of a base station according to various embodiments of the disclosure.
Figure 3B:
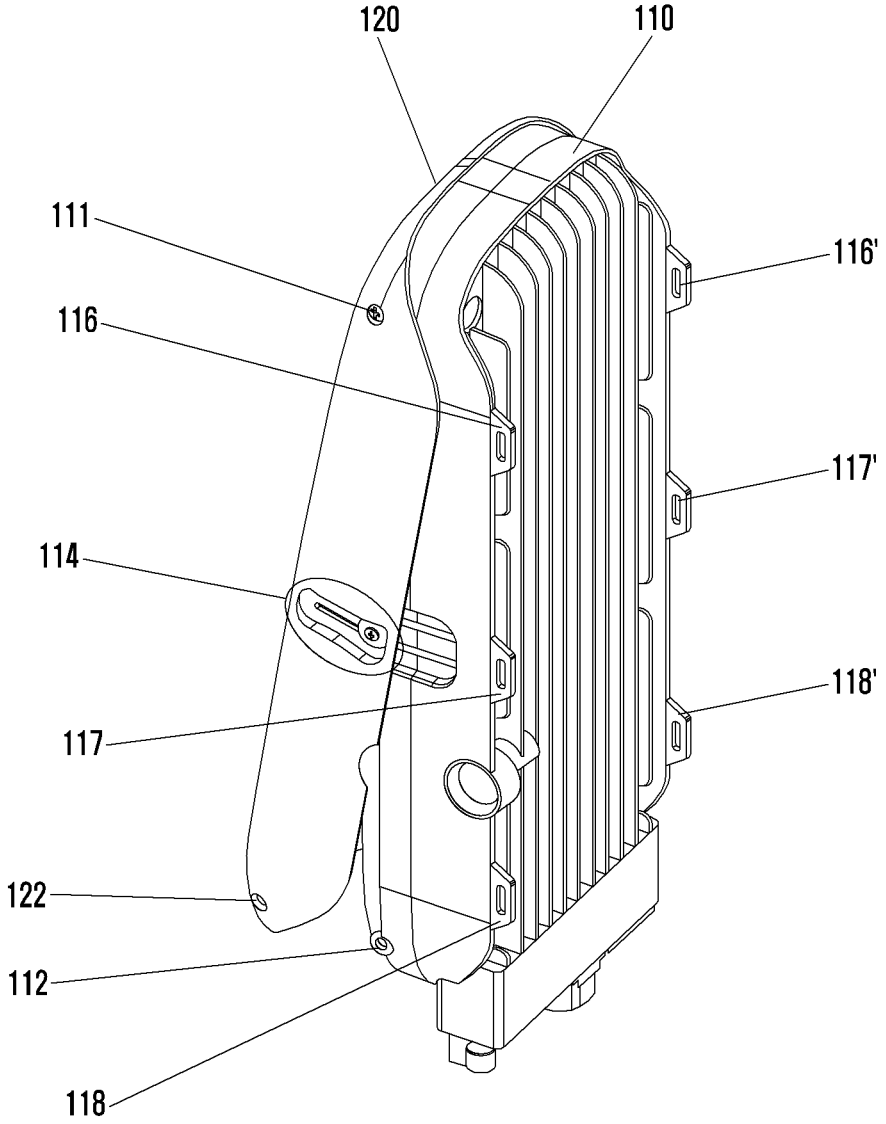
Figure 3C:
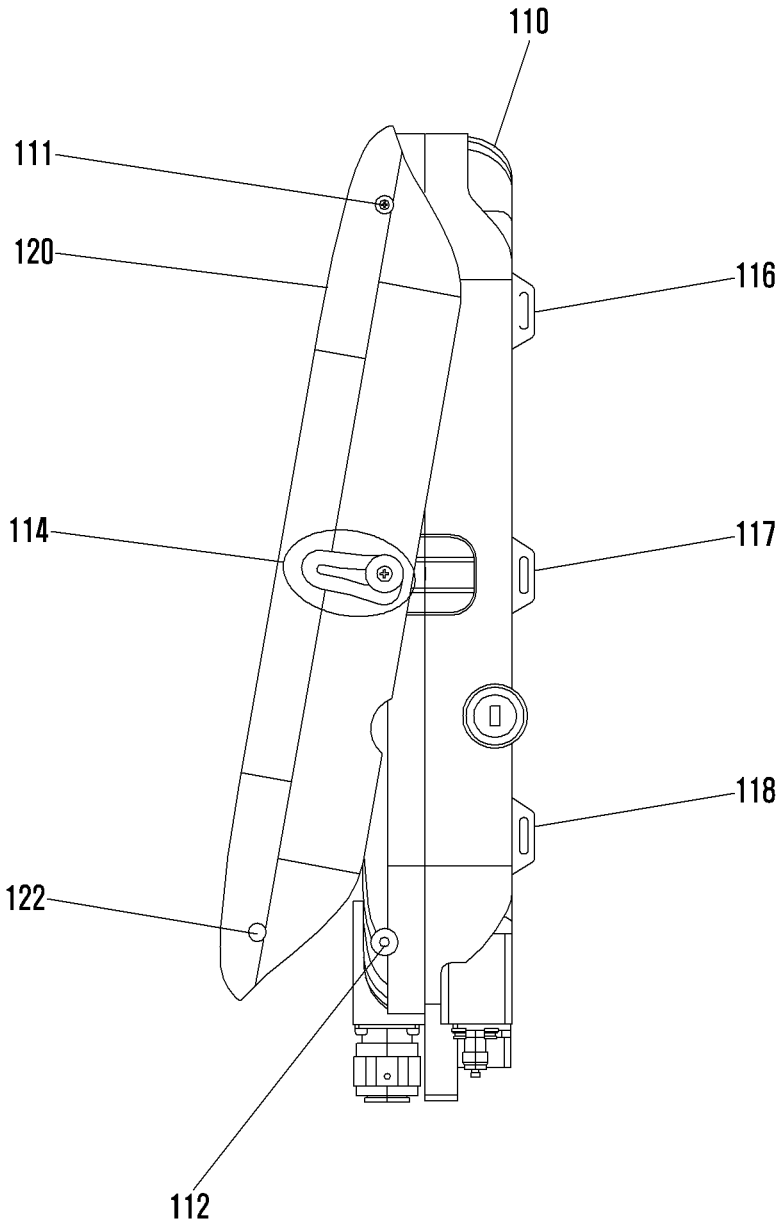
Figure 4A:
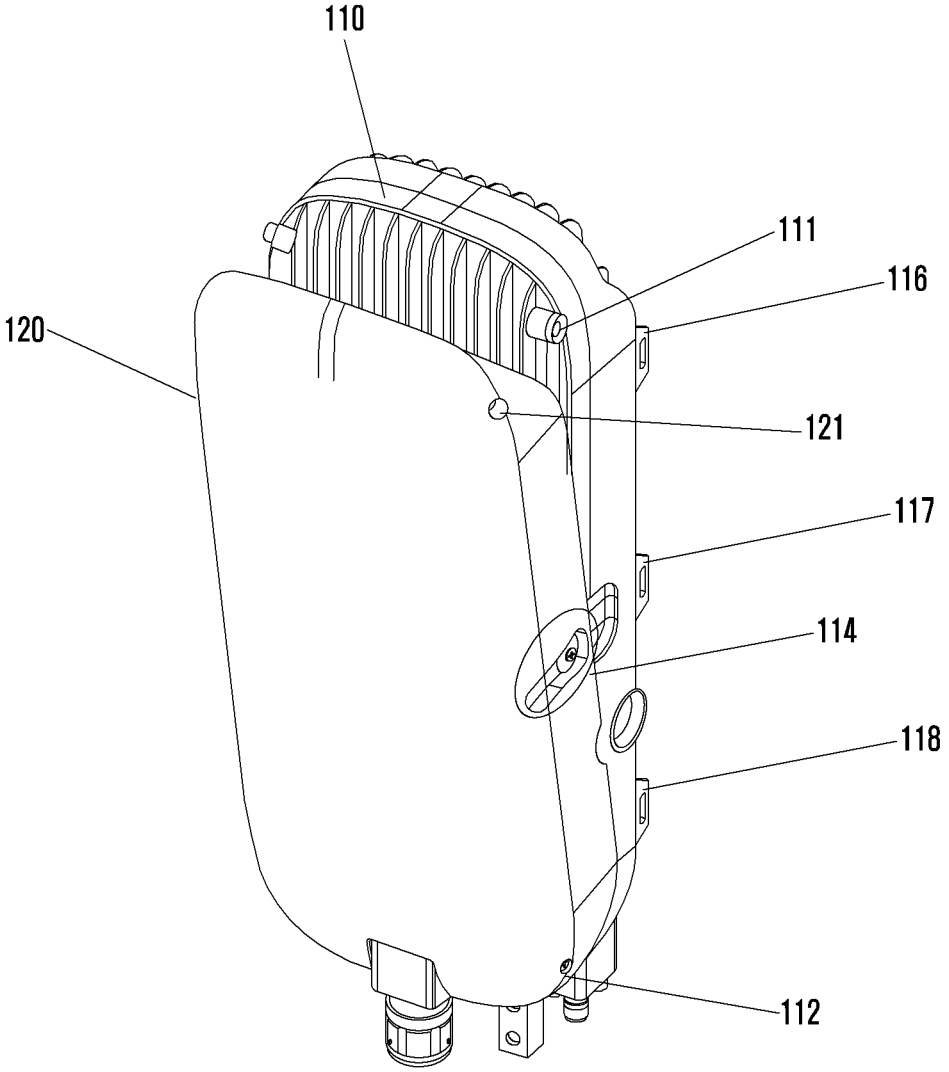
FIGS. 4A, 4B, and 4C are views illustrating an antenna assembly tilted from the top of a base station according to various embodiments of the disclosure.
Figure 4B:
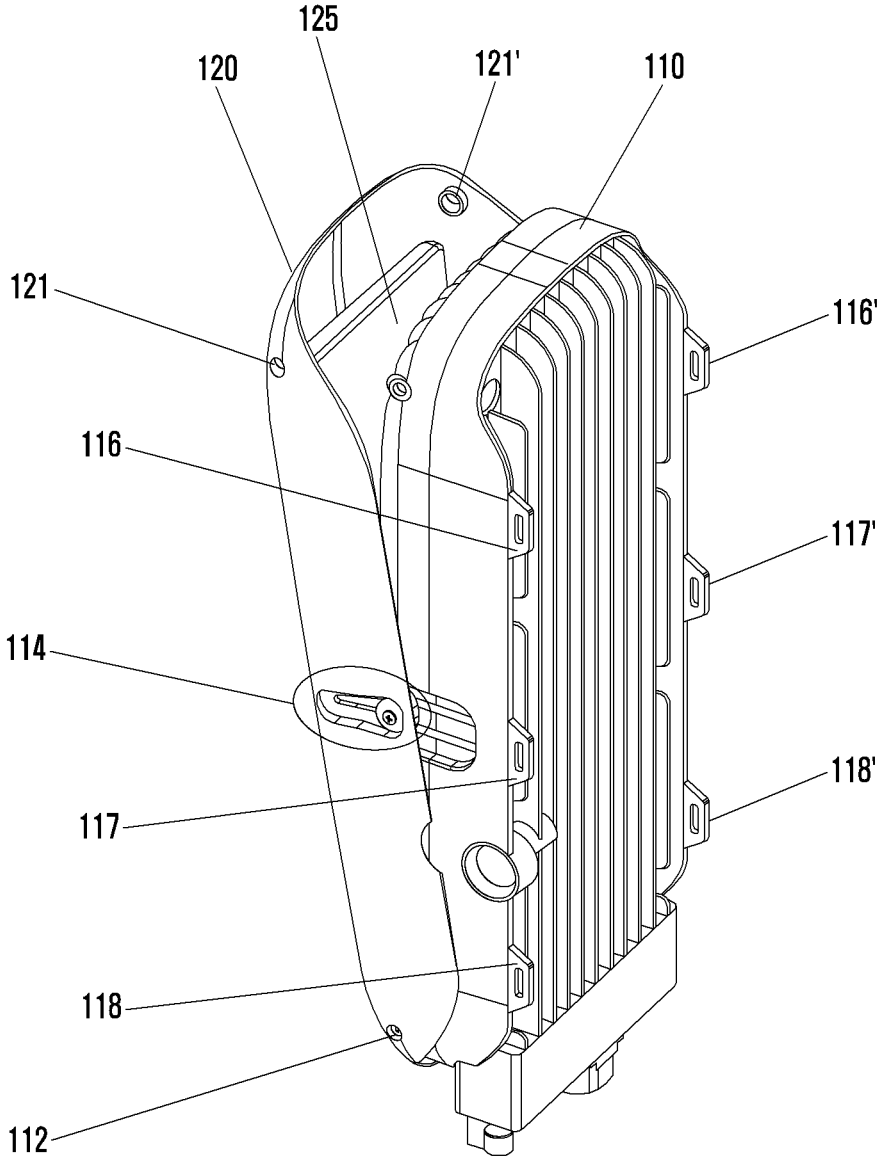
Figure 4C:
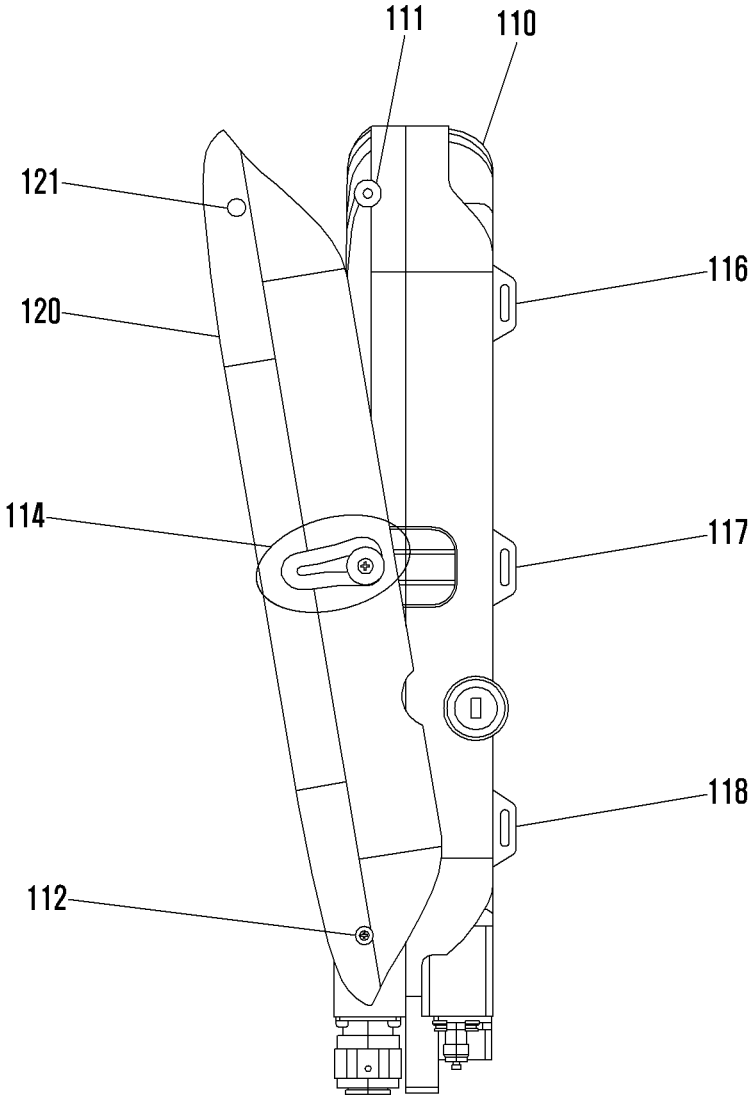

That is, the two-way mechanical tilting includes tilting from the bottom of the base station as shown in FIGS. 3A to 3C, and tilting from the top of the base station as shown in FIGS. 4A to 4C.

FIGS. 3A, 3B, and 3C are views illustrating an antenna assembly tilted from the bottom of a base station according to various embodiments of the disclosure.

Referring to FIGS. 3A, 3B, and 3C, in this case, the antenna assembly 120 is combined with the enclosure 110 through the first antenna assembly combinable member 111.

In addition, although not shown, the second antenna assembly combinable member may be used together with the first antenna assembly combinable member 111. As described above, the second antenna assembly combinable member may be disposed on one upper lateral side of the enclosure 110 opposite to an upper lateral side where the first antenna assembly combinable member 111 is disposed.

On the other hand, the third antenna assembly combinable member 112 is not used for combining the antenna assembly 120 and the enclosure 110. That is, a combination between the antenna assembly 120 and the enclosure 110 through the third antenna assembly combinable member 112 is released. In addition, although not shown, a combination between the antenna assembly 120 and the enclosure 110 through the fourth antenna assembly combinable member is also released.

Therefore, the third enclosure combinable hole 122 formed in the antenna assembly 120 is separated from the third antenna assembly combinable member 112 as shown in FIGS. 3A to 3C. Similarly, the fourth enclosure combinable hole (not shown, but described above) formed in the antenna assembly 120 is also separated from the fourth antenna assembly combinable member.

As shown in FIGS. 3A to 3C, the antenna assembly 120 may be rotated at a predetermined angle on a pivot formed by a pair of the first antenna assembly combinable member 111 and the second antenna assembly combinable member (not shown). Thus, the antenna (125 in FIGS. 2A and 2B) joined to the antenna assembly 120 may be mechanically tilted through the rotation of the antenna assembly 120.

The antenna assembly 120 rotated at a predetermined angle may maintain the angle of rotation through at least one of the first supporting member 114 and the second supporting member (not shown). That is, the supporting member may perform a function of maintaining a tilting angle between the antenna assembly 120 and the enclosure 110.

Although it is described that the tilting angle between the antenna assembly 120 and the enclosure 110 is maintained through the supporting member, this is not to be construed as a limitation of the disclosure. Alternatively, if the antenna assembly combinable member has a function of maintaining the tilting angle, the supporting member may not be used.

For example, if at least one of the first and second antenna assembly combinable members has a pivotable and locking structure (i.e., a structure capable of being locked after rotation of a certain angle), the supporting member may be excluded from the base station configuration.

In the structure shown in FIGS. 3A to 3C, the base station allows the antenna assembly to be rotated at a predetermined angle from the bottom thereof, and thus the antenna joined to the antenna assembly can be tilted at the predetermined angle from the bottom thereof.

FIGS. 4A, 4B, and 4C are views illustrating an antenna assembly tilted from the top of a base station according to various embodiments of the disclosure.

Referring to FIGS. 4A, 4B, and 4C, in this case, the antenna assembly 120 is combined with the enclosure 110 through the third antenna assembly combinable member 112. In addition, although not shown, the fourth antenna assembly combinable member may be used together with the third antenna assembly combinable member 112. As described above, the fourth antenna assembly combinable member may be disposed on one lower lateral side of the enclosure 110 opposite to a lower lateral side where the third antenna assembly combinable member 112 is disposed.

On the other hand, the first antenna assembly combinable member 111 is not used for combining the antenna assembly 120 and the enclosure 110. That is, a combination between the antenna assembly 120 and the enclosure 110 through the first antenna assembly combinable member 111 is released. In addition, although not shown, a combination between the antenna assembly 120 and the enclosure 110 through the second antenna assembly combinable member is also released.

Therefore, the first enclosure combinable hole 121 formed in the antenna assembly 120 is separated from the first antenna assembly combinable member 111 as shown in FIGS. 4A to 4C. Similarly, the second enclosure combinable hole (not shown, but described above) formed in the antenna assembly 120 is also separated from the second antenna assembly combinable member.

As shown in FIGS. 4A to 4C, the antenna assembly 120 may be rotated at a predetermined angle on a pivot formed by a pair of the third antenna assembly combinable member 112 and the fourth antenna assembly combinable member (not shown). Thus, the antenna (125 in FIGS. 2A and 2B) joined to the antenna assembly 120 may be mechanically tilted through the rotation of the antenna assembly 120.

The antenna assembly 120 rotated at a predetermined angle may maintain the angle of rotation through at least one of the first supporting member 114 and the second supporting member (not shown). That is, the supporting member may perform a function of maintaining a tilting angle between the antenna assembly 120 and the enclosure 110.

In the structure shown in FIGS. 4A to 4C, the base station allows the antenna assembly to be rotated at a predetermined angle from the top thereof, and thus the antenna joined to the antenna assembly can be tilted at the predetermined angle from the top thereof.

Therefore, according to the base station structure disclosed herein, the base station allows tilting of the antenna from the top or bottom of the enclosure, depending on a position of combination between the enclosure and the antenna assembly.

Specifically, when the antenna assembly and the enclosure are combined with each other through a pair of upper (i.e., first and second) antenna assembly combinable members, the base station allows tilting of the antenna from the bottom thereof. Similarly, when the antenna assembly and the enclosure are combined with each other through a pair of lower (i.e., third and fourth) antenna assembly combinable members, the base station allows tilting of the antenna from the top thereof.

That is, the base station according to the disclosure allows two-way mechanical tilting of the antenna, and a tilting direction of the antenna may be determined based on a position of combination between the antenna assembly and the enclosure.

Figure 5A:
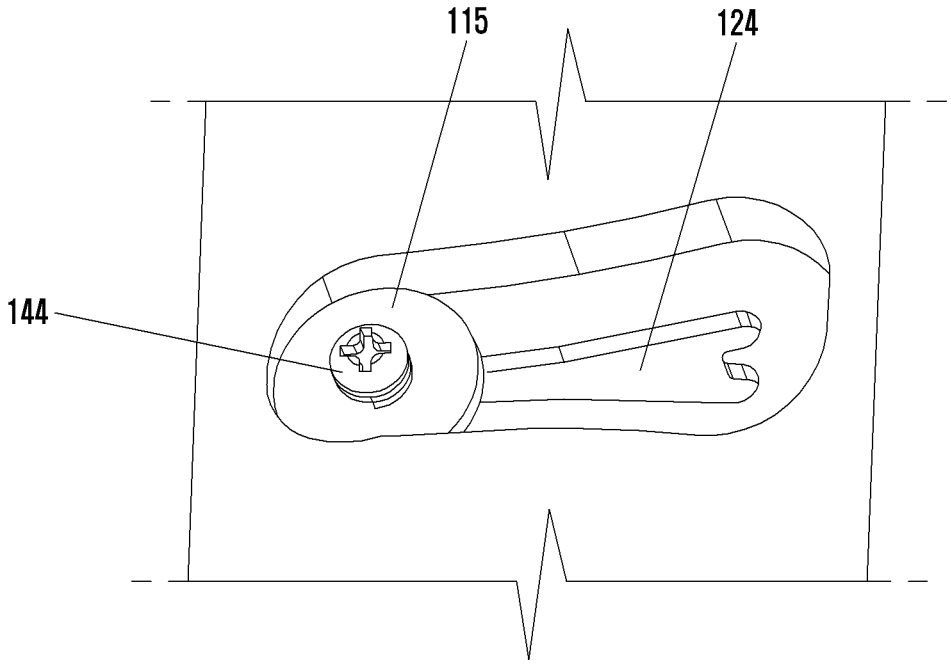
FIGS. 5A and 5B are enlarged views of a supporting member of a base station according to various embodiments of the disclosure.
Figure 5B:
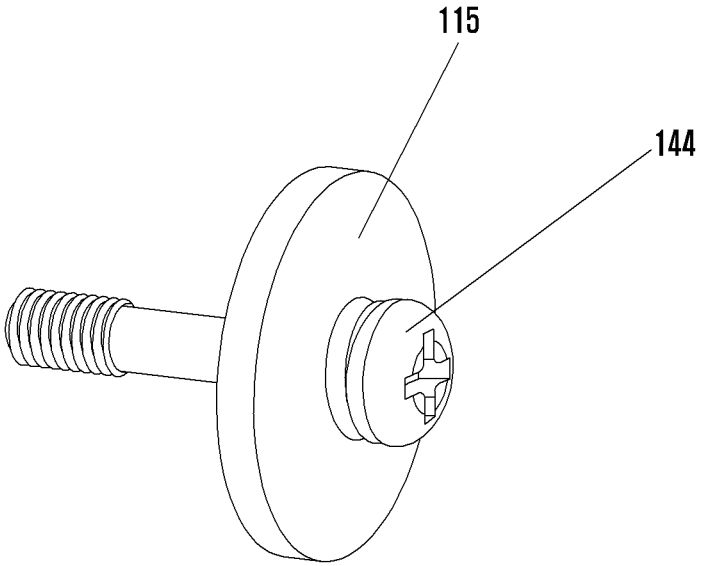

FIGS. 5A and 5B are enlarged views of a supporting member of a base station according to various embodiments of the disclosure.

Referring to FIGS. 5A and 5B, the supporting member may include a fastening protrusion 144 and a washer 115. The fastening protrusion 144 is joined to the enclosure and protrudes toward the antenna assembly. The washer 115 is engaged with the fastening protrusion 144. In addition, as shown in FIG. 5A, the antenna assembly may include the first elongated hole 124. The position of the first elongated hole 124 corresponds to the position of the fastening protrusion 144, and the fastening protrusion 144 is inserted into the first elongated hole 124.

The fastening protrusion 144 may be formed of a screw as shown in FIG. 5B, and be detachably joined to the enclosure through a screw thread. This is, however, not to be construed as a limitation of the disclosure. Alternatively, the fastening protrusion may have a structure integrally joined to the enclosure.

When the fastening protrusion 144 is inserted into the first elongated hole 124, the washer 115 is interposed between them in order to prevent the fastening protrusion 144 from being removed from the first elongated hole 124. Further, the washer 115 may disperse a pressure caused by the fastening protrusion 144.

As shown in FIG. 5A, the first elongated hole 124 may have a width increasing toward one end thereof. That is, the width of the first elongated hole 124 may be widened gradually toward a communication pole to be connected to the enclosure. This is associated with two-way tilting of the antenna. That is, the fastening protrusion 144 moves in slightly different directions along the first elongated hole 124 when the antenna assembly is rotated from the top thereof and from the bottom thereof. Therefore, for a smooth rotation of the antenna assembly, it is desirable that the first elongated hole 124 has a width increasing toward a communication pole to be connected to the enclosure.

Specifically, as shown in FIG. 5A, the first elongated hole 124 may be formed in a Y-shape, namely, formed of one main portion and two branch portions. On the one hand, the movement of the fastening protrusion 144 from the main portion to an upper branch portion indicates that the antenna assembly rotates from the bottom thereof. That is, this case means that the antenna is tilted from the bottom thereof.

On the other hand, the movement of the fastening protrusion 144 from the main portion to a lower branch portion indicates that the antenna assembly rotates from the top thereof. That is, this case means that the antenna is tilted from the top thereof.

Meanwhile, although not shown in FIG. 5A, the first elongated hole 124 may have a plurality of stoppers each having a relatively smaller width. Each stopper indicates an inwardly curved (i.e., narrowed) part of the first elongated hole 124. The plurality of stoppers permit a plurality of tilting angles between the antenna assembly and the enclosure.

Specifically, when the fastening protrusion 144 moves from one end of the first elongated hole 124 to the other end, the fastening protrusion 144 may stop at each stopper. That is, because the first elongated hole 124 has a narrow width at each stopper, the fastening protrusion 144 may remain stationary at each stopper while a tilting angle corresponding to each stopper is maintained.

Therefore, based on the number of the stoppers formed to have a narrow width in the first elongated hole 124, types of an angle formed by the antenna assembly and the enclosure, namely, types of an available angle for antenna tilting may be determined.

For example, if the maximum angle formed by the antenna assembly and the enclosure is 10 degrees, and if five stoppers are formed at regular intervals in the first elongated hole 124, available antenna tilting angles may be 0, 2, 4, 6, 8, and 10 degrees.

In addition, although not shown, the supporting member may further have an elastic part formed between the enclosure and the fastening protrusion 144. The elastic part may elastically join the enclosure and the fastening protrusion 144 in order to easily move again, by using an elastic force, the fastening protrusion 144 remaining stationary at one of the stoppers.

Although FIG. 5A shows the first elongated hole 124 formed in the Y-shape, this is not to be construed as a limitation. In addition, the number of stoppers formed in and along the first elongated hole 124 is not limited to a specific value, and the stoppers may be formed in and along the first elongated hole 124 at regular intervals or irregular intervals. The structure, configuration, shape, etc. of the supporting member as shown in FIGS. 5A and 5B are not to be construed as a limitation of the disclosure.

Figure 6:
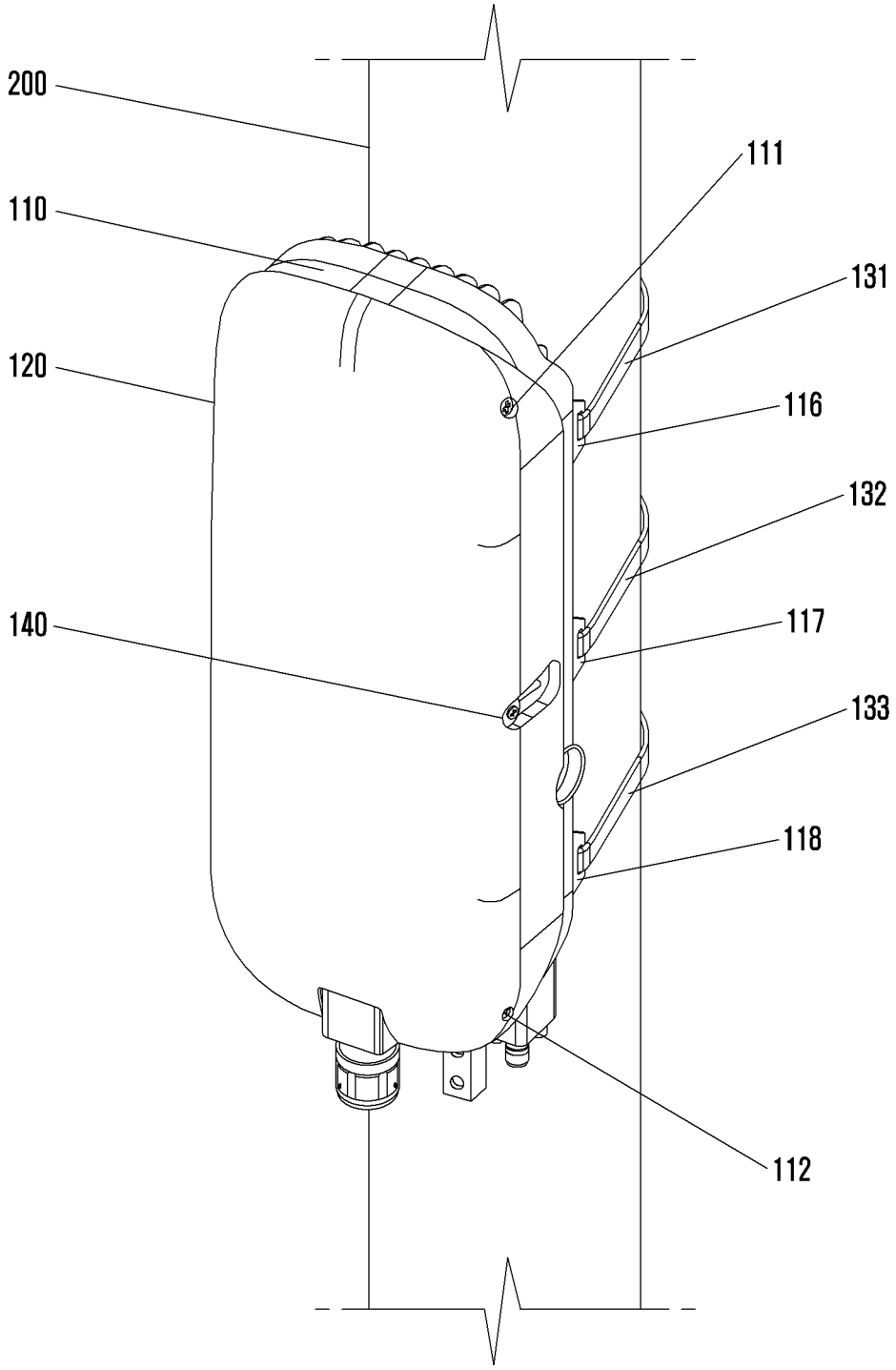
FIG. 6 is a view illustrating a base station connected to a communication pole according to an embodiment of the disclosure.

FIG. 6 is a view illustrating a base station connected to a communication pole according to an embodiment of the disclosure.

Referring to FIG. 6, the base station according to the disclosure may be connected to a communication pole 200 through pole connectable parts 116, 116', 117, 117', 118, and 118' formed on the enclosure 110 and through pole connectors 131, 132, and 133. The pole connectors 131, 132, and 133 may be a sort of accessory such as a metal band, which is an item separate from the base station disclosed in the disclosure.

Meanwhile, the base station may further include a cover 140 for covering both the fastening protrusion joined to the enclosure 110 and the elongated hole formed in the antenna assembly 120. The cover 140 may prevent foreign matter from penetrating into the elongated hole and also prevent the fastening protrusion from being damaged due to an external impact.

FIG. 6 shows that the enclosure 110 and the antenna assembly 120 are combined with each other through all antenna assembly combinable members including the first antenna assembly combinable member 111 and the third antenna assembly combinable member 112 as shown in FIGS. 1A to 1C. That is, the base station shown in FIG. 6 is in a state where no antenna tilting is performed.

However, the base station connected to the communication pole 200 may be in a state of antenna tilting from the bottom thereof when the first antenna assembly combinable member 111 is combined and the third antenna assembly combinable member 112 is released as shown in FIGS. 3A to 3C. Also, the base station connected to the communication pole 200 may be in a state of antenna tilting from the top thereof when the first antenna assembly combinable member 111 is released and the third antenna assembly combinable member 112 is combined as shown in FIGS. 4A to 4C.

Accordingly, the base station connected to the communication pole makes it possible to radiate radio waves upwardly as well as downwardly through two-way antenna tilting. That is, the base station according to the disclosure can transmit and receive a signal to and from a terminal located at a higher position than the base station as well as a terminal located at a lower position.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A base station comprising:

an enclosure including a plurality of pole connectors for connecting the base station to a communication pole, two upper antenna assembly combinable members, each of which disposed on each of upper lateral sides of the enclosure, the two upper antenna assembly combinable members including a first antenna assembly combinable member and a second antenna assembly combinable member, two lower antenna assembly combinable members, each of which disposed on each of lower lateral sides of the enclosure, the two lower antenna assembly combinable members including a third antenna assembly combinable member and a fourth antenna assembly combinable member, a first supporting member disposed between the first antenna assembly combinable member and the third antenna assembly combinable member, and performing a function of maintaining a tilting angle of an antenna assembly from the enclosure, a second supporting member disposed between the second and fourth antenna assembly combinable members and performing the function of maintaining the tilting angle, the first and second supporting members each being disposed respectively on each of middle lateral sides of the enclosure; and the antenna assembly including an antenna for communication and combined with the enclosure, wherein the antenna assembly is rotated at a predetermined angle, by combining the two upper antenna assembly combinable members with the antenna assembly and releasing a combination of the two lower antenna assembly combinable members from the antenna assembly, or by combining the two lower antenna assembly combinable members with the antenna assembly and releasing a combination of the two upper antenna assembly combinable members from the antenna assembly, and wherein the antenna assembly further includes a first elongated hole at a position corresponding to a position of the first supporting member, the first elongated hole for engaging with the first supporting member of the enclosure using a first protrusion, and a second elongated hole at a position corresponding to a position of the second supporting member, the second elongated hole for engaging with the second supporting member of the enclosure.

2. The base station of claim 1, wherein a width of each of the first and second elongated holes is widened gradually toward the communication pole.

3. The base station of claimer 1, wherein the first and second supporting members include first and second fastening protrusions, respectively, each protrusion joined to the enclosure and protruding toward the antenna assembly.

4. The base station of claim 3, wherein the first supporting member further includes a first washer engaged with the first fastening protrusion, and a first cover covering the first fastening protrusion, and wherein the second supporting member further includes a second washer engaged with the second fastening protrusion, and a second cover covering the second fastening protrusion.

5. The base station of claim 2, wherein the width of each of the first and second elongated holes is widened gradually toward the communication pole to be connected to the enclosure.

* * * * *